US005863027A

United States Patent [19]

Pattison

[11] Patent Number: 5,863,027

[45] Date of Patent: Jan. 26, 1999

[54] HOOK MOUNTED CONTROL DEVICE

[75] Inventor: Stuart R. Pattison, Williamsville, N.Y.

[73] Assignee: Columbus McKinnon Corporation, Amherst, N.Y.

[21] Appl. No.: 702,962

[22] Filed: Aug. 26, 1996

[51] Int. Cl.[6] ..... B66D 1/00

[52] U.S. Cl. ..... 254/266; 212/285

[58] Field of Search ..... 254/266, 270; 212/330, 331, 338, 285; 414/2, 4, 5

[56] References Cited

U.S. PATENT DOCUMENTS

| | | | |
|---|---|---|---|
| 2,940,608 | 6/1960 | Underwood et al. | 212/330 |
| 3,545,051 | 12/1970 | Kennard | 24/241 |
| 3,654,415 | 4/1972 | Hawkins et al. | 200/168 G |
| 3,921,959 | 11/1975 | Ulbing | 254/168 |
| 3,948,487 | 4/1976 | Motoda | 254/173 R |
| 4,026,526 | 5/1977 | Messerschmidt et al. | 254/168 |
| 4,844,421 | 7/1989 | Kojima | 254/270 |
| 4,917,360 | 4/1990 | Kojima | 254/362 |
| 5,480,125 | 1/1996 | Bitsch et al. | 254/264 |
| 5,489,032 | 2/1996 | Mayhall, Jr. et al. | 212/285 |

*Primary Examiner*—Katherine Matecki
*Attorney, Agent, or Firm*—Bean, Kauffman & Snyder

[57] ABSTRACT

A control device is mounted in association with a hook suspended by a chain from an electrically operated hoist and includes a hand grip fitted with control switches controlling lowering and raising movements of the hook and a mounting device for removably mounting the hand grip horizontally adjacent the hook and for vertical movement therewith.

9 Claims, 2 Drawing Sheets

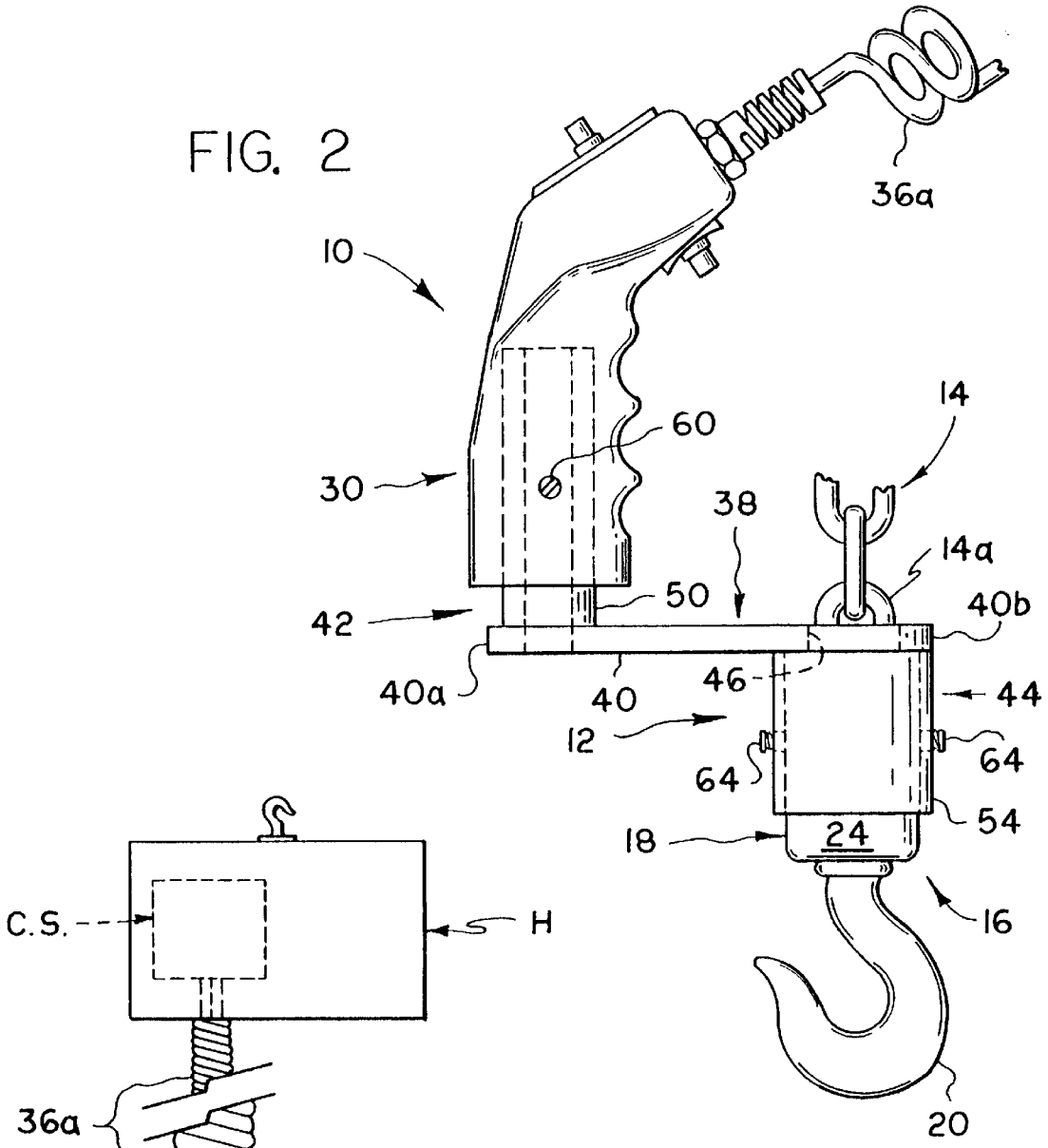
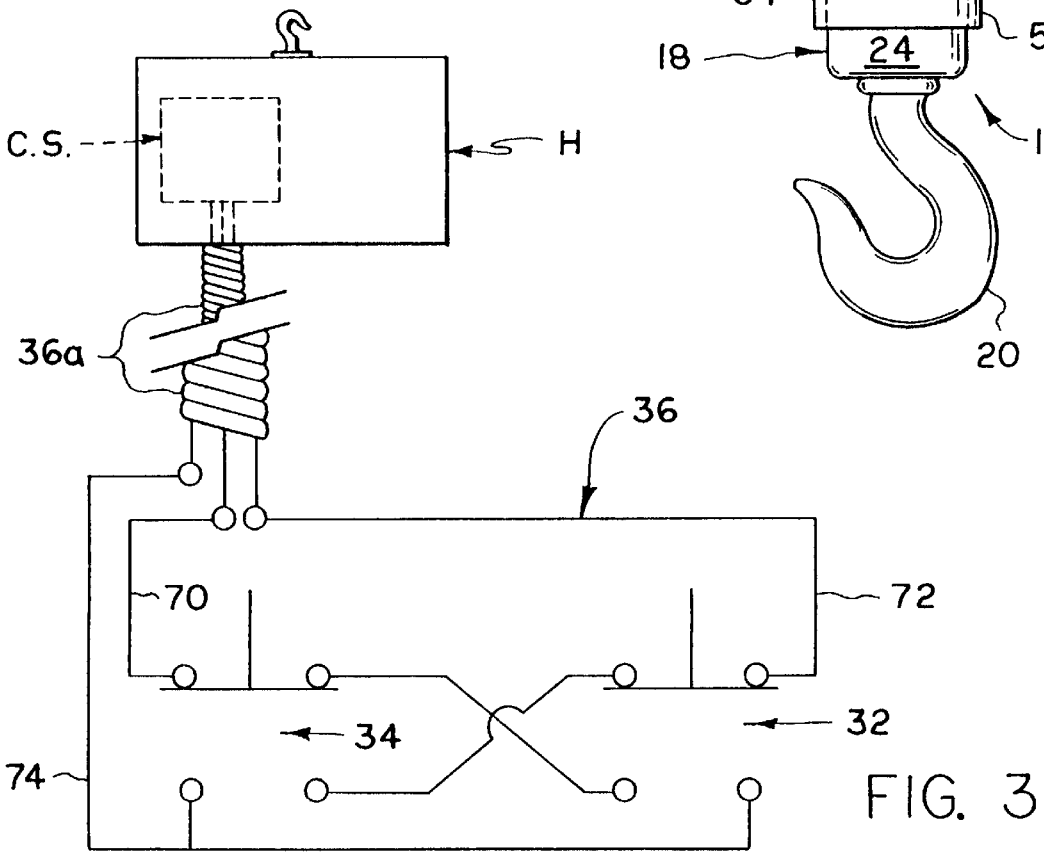
FIG. 3

HOOK MOUNTED CONTROL DEVICE

BACKGROUND OF THE INVENTION

Electrically operated hoists or load balancers are commonly controlled by operator manipulations of pendant control devices suspended directly from a hoist, such as is disclosed for example in U.S. Pat. No. 3,654,415 or control devices adapted for vertical movement with a load attachment device, such as is disclosed for example in U.S. Pat. Nos. 3,921,959; 3,948,487; 4,026,526; 4,844,421; 4,917,360; and 5,480,125.

Control devices adapted for movement vertically with a load attachment device maximizes the degree of control an operator can exert with regard to accurate positioning of a load. A drawback of known control devices of this type is that they are designed to interconnect a load attachment device, such as a hook, with the load lift chain or wire rope of the hoist, and thus are required to have a strength sufficient to withstand a maximum load for which the hoist is designed to lift. This results in complex and costly construction, which is not readily adopted for removable attachment to lifting elements of the hoist, so as to permit retrofitting of existing hoist installations.

SUMMARY OF THE INVENTION

The present invention is directed towards an improved control device for power operated hoists of the type adapted for vertical movement with a load attachment device, such as a hook, wherein the control device is not required to bear any portion of the load lifted by the hoist and may be easily and quickly removably attached for movement with the load attachment device.

In a preferred form of the present invention, a control device includes a hand grip fitted with control switches for controlling lowering and raising movements of a load lift chain and a mounting device for removably mounting the hand grip horizontally adjacent to and for vertical movement with a conventional hook block by which a load attachment device, such as a hook, is removably connected to the chain.

The mounting device of the invention may comprise an elongated mounting platform or plate having a first mounting means arranged adjacent a first end of the platform for use in mounting the hand grip and a second mounting means arranged adjacent a second or opposite end of the platform for use in attaching the control device to the hook block, with the second end being formed with a through opening to loosely receive a lower end of the chain to which the hook block is attached. Preferably, the first mounting means is a first mounting sleeve arranged to upstand from the mounting platform for receipt within a cylindrical mounting opening defined by the hand grip, and the second mounting means is a second mounting sleeve arranged to depend from the mounting platform in alignment with the chain mounting opening and sized to slidably receive the hook block therewithin. The hand grip and the hook block may be removably fixed to the first and second mounting sleeves by one or more set screws.

BRIEF DESCRIPTION OF THE DRAWINGS

The nature and mode of operation of the present invention will now be more fully described in the following detailed description taken with the accompanying drawings wherein:

FIG. 2 is an assembled elevational view of the control device mounted on a hook block; and FIG. 3 is a diagrammatic view of the control circuit fitted within the hand grip of the control device.

DETAILED DESCRIPTION

Figure 1:
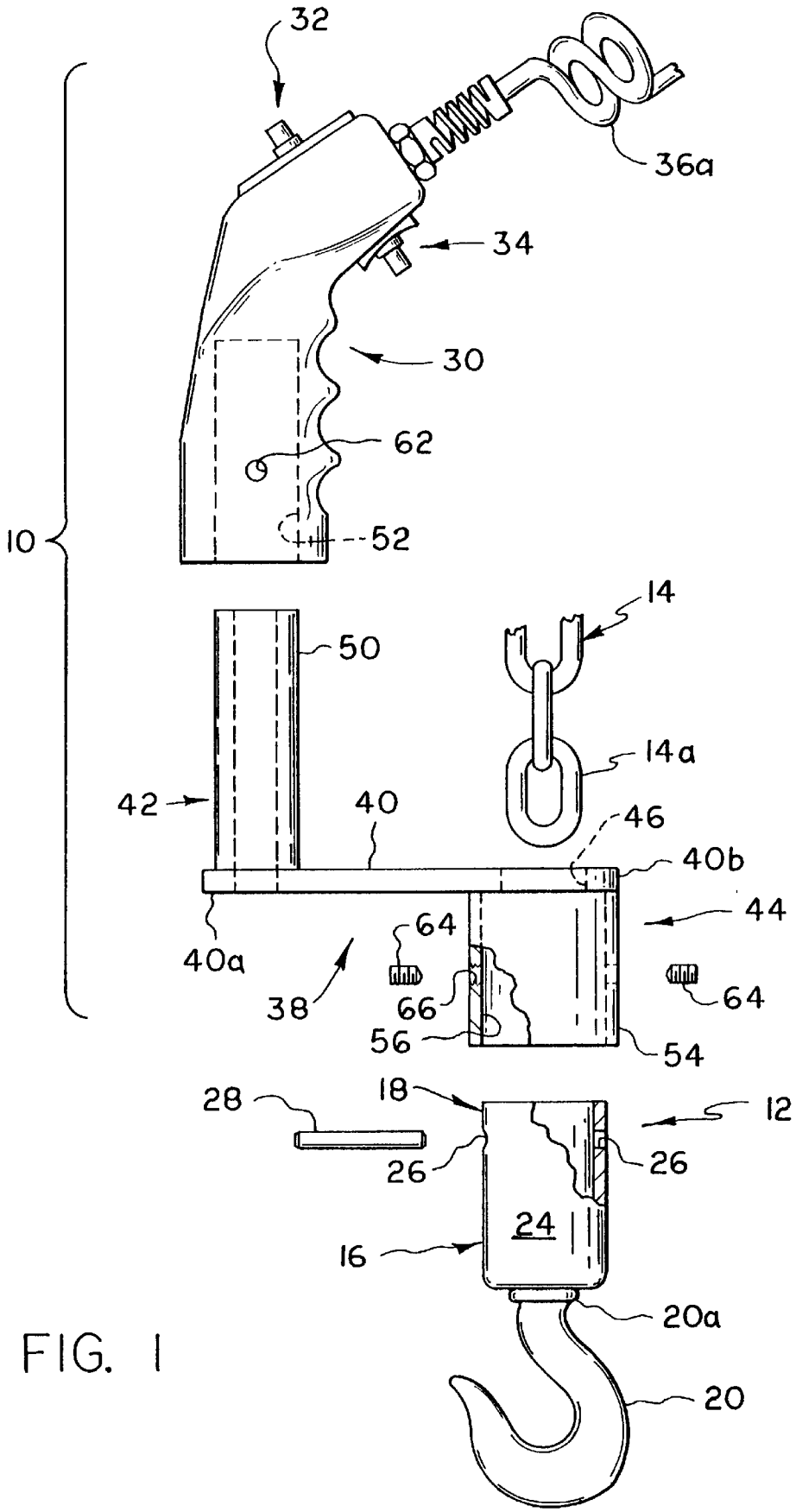
FIG. 1 is an exploded elevational view of a hoist control device of the present inventor.

A hook mounted control device of the present invention is generally designated as 10 and shown in FIGS. 1 and 2 in association with load lifting assembly 12 depending from a power driven hoist, such as an electric motor driven hoist designated as H only in FIG. 3, which assembly comprises a flexible load lift element, such as a link chain 14, and a suitable coupling means, such as a hook block 16 including a cup shaped, swivel mounting member 18 serving to couple the chain to a suitable load attachment device, such as a hook 20.

The power driven hoist with which the present control device is adapted for use may be of any desired hoist construction capable of effecting lifting and lowering movements of chain 14 under the control of an electric motor directional control circuit designated as C. S. only in FIG. 3.

Hook block 16 may, for example, be similar in construction to that shown in U.S. Pat. No. 3,545,051, whose disclosure is incorporated by reference herein. However, to facilitate understanding of the mode of operation of hook block 16, it will be noted that a cup shaped mounting member 18 is formed with a cylindrical side wall 24 having a pair of aligned bearing openings 26 and 26 sized to receive opposite ends of a dowel pin 28 whose midportion is removably inserted through the last or lowermost link 14*a* of lift chain 14 for purposes of removably connecting hook 20 to the lift chain. The shank 20*a* of hook 20 may pass upwardly through an opening, not shown, formed in mounting member 18 and such shank may be supported internally of the mounting member 18 to permit the hook to swivel relative thereto.

Again referring to FIGS. 1 an 2, it will be understood that control device 10 comprises a suitable manually manipulable control means, such as molded plastic hand grip 30, which is fitted adjacent its upper end with a "down" control switch 32 and an "up" control switch 34 individually manually operable for controlling lowering and raising movements of chain 14 and serves to house the switch operated control circuit 36, shown in FIG. 3, communicating with the hoist being controlled by a flexibly, coiled electrical cable 36*a*. Control device 10 also includes a mounting device 38 for removably mounting hand grip 30 horizontally adjacent to and for vertical movement with hook block 16, and thus hook 20.

Mounting device 38 comprises an elongated mounting platform or plate 40 having a first mounting means 42 arranged adjacent a first end 40*a* for use in mounting hand grip 30 and a second mounting means 44 arranged adjacent a second end 40*b* for use in removably connecting control device 10 to hook block 16. Second end 40*b* is formed with a vertically extending through mounting opening 46 sized to loosely receive the lower end of chain 14. Preferably, first mounting means 42 is defined by a first mounting sleeve 50 arranged to upstand from platform 40 for slidable receipt within a cylindrical mounting opening 52 defined by hand grip 30; and second mounting means 44 is defined by a second mounting sleeve 54 arranged to depend from the platform to define a downwardly opening recess 56 arranged in alignment with mounting opening 46 and sized to slidably receive cylindrical side wall 24 of mounting member 18. Also, it is preferable to form first and second mounting sleeves 50 and 54 and mounting platform 40 of a suitable metal, such as aluminum, and permanently join same together by suitable means, such as by welding. Hand grip may be removably attached to first mounting sleeve 50 by at least one set screw 60 threadably received within a threaded opening 62 formed in the hand grip, and second mounting sleeve 54 may be removably attached to side wall 24 by at least one set screw 64 threadably received within a threaded opening 66 formed in the second mounting sleeve.

Now referring to FIG. 3, it will be understood that switches 32 and 34 are biased by suitable means, not shown, to normally assume their illustrated extended or open positions and manually operable for purposes of alternatively connecting "down" and "up" wires 70 and 72 to common wire 74. The illustrated circuit is designed such that the simultaneous manual operation or closing of switches 32 and 34 will not serve to connect either of wires 70 or 72 to common wire 74. As will be apparent, wires 70, 72 and 74 are housed in electrical cable 36*a*.

Installation of control device 10 is accomplished after interrupting power to the hoist motor circuit by removing dowel pin 28 from mounting member 18 in order to separate hook block 16 from lift chain 14. Control device 10 is then associated with chain 14 by threading the chain downwardly through mounting opening 46 and thereafter reinserting dowel pin 28 through bearing openings 26 and 26 and chain end link 14*a* to reconnect hook block 16 to the chain. Assembly of control 10 device relative to hook block 16 is completed by sliding cylindrical side wall 24 upwardly within second mounting sleeve 54 and tightening set screw (s) 64 sufficiently to clamp against the cylindrical side wall. Finally, an upper end of electric cable 36*a* is suitably connected into the directional control circuit for the electric hoist.

While the control device of the present invention is primarily intended for electrically operated chain hoists, including balancers, it is contemplated that such control device has utility with electrically operated wire rope type hoists or with pneumatically operated type hoists, wherein the switches associated with the hand grip are either electric or pneumatic depending on the type of hoist motor directional control system to be employed.

Further, it is intended that the term load attachment device will include any device suitable for use in attaching a load to a flexible load lift element of a hoist or load balancer.

What is claimed is:

1. A control device for controlling lifting and lowering operations of a hoist having a vertically movable flexible load lifting element whose lower end is removably connected by coupling means to a load attachment device, said control device comprising:

a manually manipulable control means having switch means adapted for controlling said lifting and lowering operations of said hoist; and mounting means for removably connecting said control means horizontally adjacent said coupling means and for vertical movement therewith, said mounting means includes a mounting platform having first and second ends, a first mounting means for mounting said control means adjacent first end and a second mounting means for removably connecting said coupling means to said second end.

2. A control device according to claim 1, wherein said second mounting means defines a downwardly opening recess sized to receive said coupling means and has means for removably retaining said coupling means within said recess.

3. A control device according to claim 2, wherein said mounting platform has an opening for freely receiving said lower end of said load lifting element and disposed in alignment with said recess.

4. A control device for controlling lifting and lowering operations of a hoist having a vertically movable flexible load lifting element whose lower end is removably connected by coupling means to a load attachment device, said control device comprising:

a manually manipulable control means having switch means adapted for controlling said lifting and lowering operations of said hoist; and mounting means for removably connecting said control means horizontally adjacent said coupling means and for vertical movement therewith, said mounting means includes a mounting platform having first and second ends, a first mounting means upstanding from adjacent said first end for mounting said control means and a second mounting means depending from adjacent said second end for removable connection to said coupling means.

5. A control device according to claim 4, wherein said mounting platform has a mounting opening for freely receiving said lower end of said load lifting element, and said second mounting means includes a sleeve arranged for alignment with said mounting opening and sized to receive said coupling means, said sleeve mounting a set screw for releasably clamping said coupling means within said sleeve.

6. A control device according to claim 5, wherein said control means includes a hand grip having an opening extending upwardly within a lower end thereof and said first mounting means is received within said opening of said hand grip.

7. A control device for controlling load lifting and lowering operations of an electric hoist provided with a load lifting link chain whose lower end is removably connected to a hook block including a mounting member from which a hook depends, said control device comprising in combination:

a manually manipulated control means having switch means adapted for controlling said operations of said hoist and being connected to said hoist by a flexible electrical cable; and mounting means for connecting said control means to said hook block without said control device bearing a load lifted by said hoist, said mounting means including a mounting platform having first and second ends, a first mounting means for mounting said control means adjacent said first end and second mounting means for connecting said second end to said mounting member of said hook block for positioning said control means in horizontally spaced relation relative thereto.

8. The combination according to claim 7, wherein said mounting platform has an opening extending therethrough for freely receiving said lower end of said chain and said second mounting means includes a sleeve arranged to depend from said mounting platform in alignment with said opening and sized to slidably receive said mounting member and at least one set screw threadably mounted by said sleeve for removable clamping engagement with said mounting member.

9. The combination according to claim 8, wherein said control means includes a hand grip having a mounting opening extending upwardly through a lower end thereof and said first mounting means includes a sleeve upstanding from said first end of said mounting platform for receipt within said mounting opening of said hand grip.

* * * * *